US005370213A

United States Patent [19]

Ahls et al.

[11] Patent Number: 5,370,213

[45] Date of Patent: Dec. 6, 1994

[54] COMBPLATE WITH A WEAR RESISTANT COATING

[75] Inventors: Hermann W. Ahls, Obernkirchen; Michael Kruse, Minden, both of Germany

[73] Assignee: Otis Elevator Company, Farmington, Conn.

[21] Appl. No.: 92,175

[22] Filed: Jul. 15, 1993

[51] Int. Cl.[5] ..... B66B 29/06

[52] U.S. Cl. ..... 198/325; 198/324

[58] Field of Search ..... 198/321, 324, 325, 333

[56] References Cited

U.S. PATENT DOCUMENTS

| | | | |
|---|---|---|---|
| 2,210,711 | 8/1940 | Dunlop | 198/325 |
| 2,953,232 | 9/1960 | Bankauf et al. | 198/325 |
| 2,981,397 | 4/1961 | Hansen | 198/325 |
| 3,144,118 | 8/1964 | Fabula . | |
| 3,458,025 | 7/1969 | Earle | 198/325 |
| 3,687,257 | 8/1972 | Johnson | 198/325 |
| 4,126,218 | 11/1978 | El Taher et al. | 198/325 |
| 4,236,623 | 12/1980 | Ackert | 198/325 X |
| 4,800,998 | 1/1989 | Myrick | 198/325 X |

FOREIGN PATENT DOCUMENTS

| | | | |
|---|---|---|---|
| 0039271 | 3/1977 | Japan | 198/325 |
| 0075781 | 6/1977 | Japan | 198/324 |
| 52-75782 | 6/1977 | Japan | B66B 9/12 |
| 0075782 | 6/1977 | Japan | 198/324 |
| 0077378 | 6/1977 | Japan | 198/324 |
| 0077379 | 6/1977 | Japan | 198/324 |
| 0086591 | 3/1990 | Japan | 198/333 |
| 2137580 | 10/1984 | United Kingdom | B66B 9/12 |

OTHER PUBLICATIONS

Handbook of Plastics, Elastomers and Composites by Charles A. Harper pp. 1.2, 1.3, 10.3, 10.4, FIGS. 3.17, 3.18 (No Date).

Technical Data Sheet "Color Guard TM Tough Rubber Coating" Permatex® Industrial Newington, Conn., May 1993.

*Primary Examiner*—D. Glenn Dayoan

[57] ABSTRACT

A combplate for a people moving device is provided having a body with a top surface and a bottom surface, a comb having a plurality of fingers, and a wear resistant polymeric coating, having a color, bonded to the combplate and made of a thermal setting plasticized polyvinylchloride plastic.

9 Claims, 2 Drawing Sheets fig.2
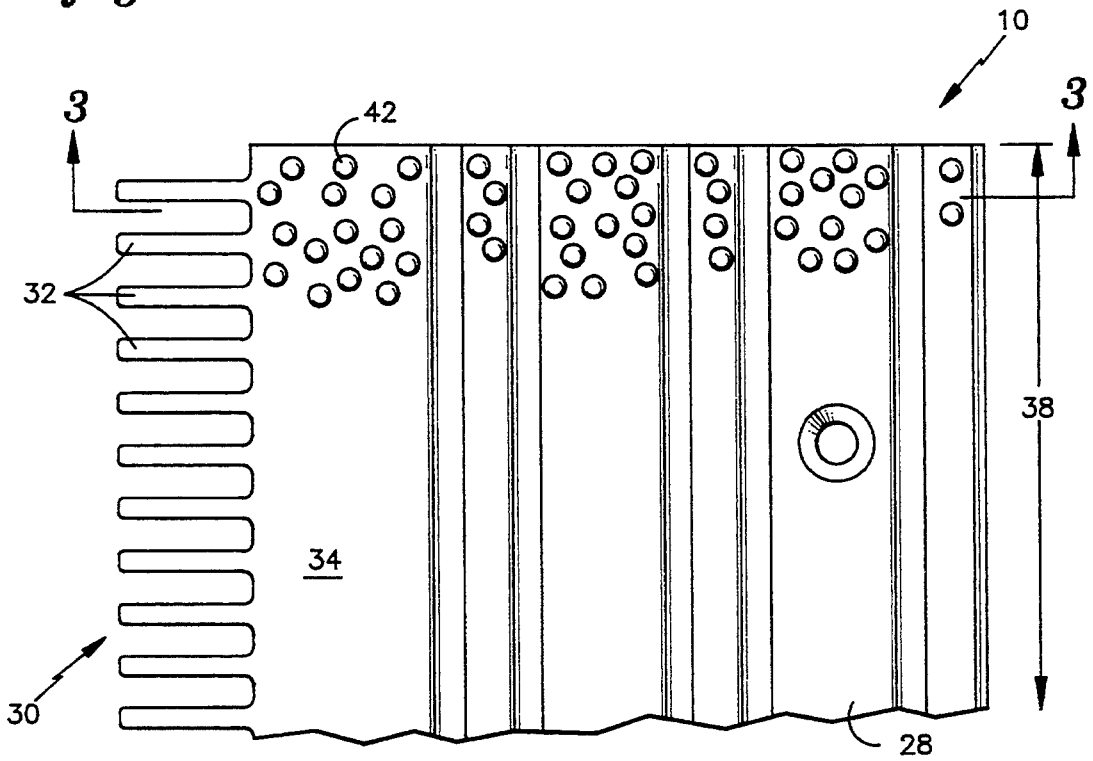
fig.3
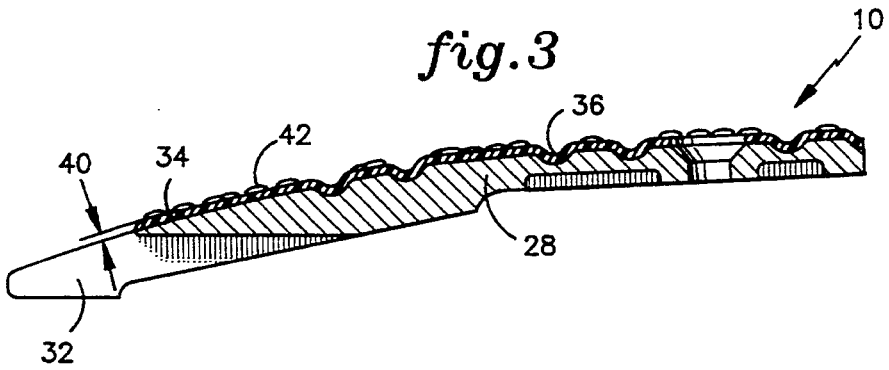
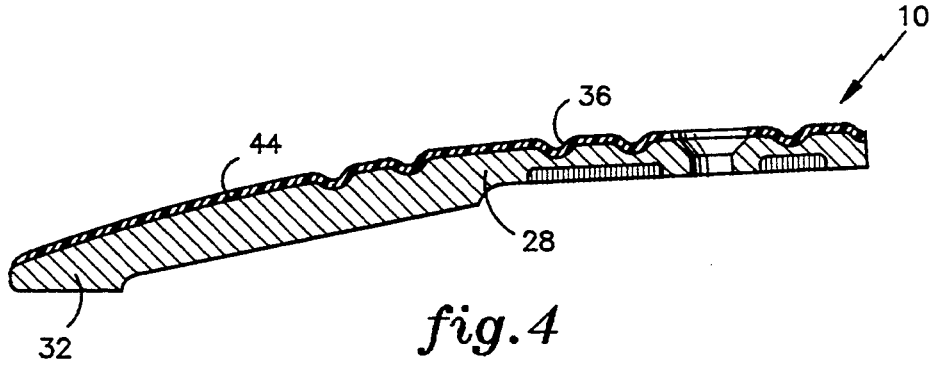
fig.4

COMBPLATE WITH A WEAR RESISTANT COATING

BACKGROUND OF THE INVENTION

1. Technical Field

The present invention relates to people moving devices in general, and to combplates for people moving devices in particular.

2. Background Art

Escalators, moving walkways, and other people moving devices efficiently move a large volume of pedestrian traffic from one point to another. Passengers step on moving steps (or belts, or pallets) and are transported along at a constant rate of speed.

The steps are attached to a step chain which travels in a closed loop from a first landing of the people moving device to a second landing and back. Specifically, the steps exit the first landing and travel exposed from the first landing to the second landing. From there, the steps reverse direction within the second landing and return to the first landing concealed within the frame of the device. Finally, the steps reverse direction within the first landing, thereby completing the loop.

A person of ordinary skill in the art recognizes that safety is a significant concern in the entry and exit points of the people moving device. Passengers go from stepping on a surface at a zero velocity to stepping on a surface at a constant velocity greater than zero. As a result, there is an opportunity for a passenger to lose his or her balance.

Numerous solutions have been offered to address these safety concerns. In some cases, for example, caution signs are deployed near the entry and exit points. These signs must be positioned out of the moving path, however, or they too become a safety hazard. Positioning the signs out of the moving path decreases the effectiveness of the warning and detracts aesthetically. In other cases, cautionary colors are painted on either the steps or the landing entry (typically called the combplate) to highlight the difference in velocity between the parts. The difficulty with a painted coating, is that a normal paint wears off relatively quickly, and therefore increases maintenance costs as well as creates an aesthetic blemish.

In still other instances, the steps are machined to accept cautionary colored plastic inserts which are typically riveted to the step. A disadvantage of this approach is that the machining process significantly increases the cost of the steps. In addition, if the insert works free from the step, the now loose insert and the machined step become a safety hazard.

In short, what is needed is a durable means for alerting passengers of the difference in surface velocity at the entry and exit points of a people moving device, which is easily recognizable.

DISCLOSURE OF THE INVENTION

It is, therefore, an object of the present invention to provide a safety device which alerts passengers of the difference in surface velocity at the entry and exits points of a people moving device which is wear resistant.

It is a further object of the present invention to provide a safety device which alerts passengers of the difference in surface velocity at the entry and exit points of a people moving device, which is easily recognized.

According to the present invention, a combplate for a people moving device is provided having a body with a top surface and a bottom surface, a comb having a plurality of fingers, and a wear resistant polymeric coating, having a color, bonded to the combplate.

According to another aspect of the present invention, the combplate body has a plurality of slots extending laterally across the width of the body.

According to another aspect of the present invention, the polymeric coating comprises a texture which increases the gripping quality of the coating.

According to another aspect of the present invention the wear resistant coating comprises a cautionary color.

An advantage of the present invention, is the wear resistant nature of the polymeric coating. The polymeric coating has a longer service life than does any of the prior art solutions. As a result, the maintenance of the escalators is minimized.

A further advantage of the present invention is that the coating may be brightly pigmented with a cautionary color, thereby highlighting the entry and exit areas of the people moving device.

A still further advantage of the present invention is that the present invention may be positioned in the direct path of the passenger. As a result, the safety alert is more apparent to passengers.

These and other objects, features and advantages of the present invention will become more apparent in light of the detailed description of the best mode embodiment thereof, as illustrated in the accompanying drawings.

BRIEF DESCRIPTION OF THE DRAWINGS

FIG. 2 is a top view of a combplate shown in FIG. 1.

FIG. 3 is a sectional view of the combplate shown in FIG. 2.

FIG. 4 is a second view of FIG. 3, showing the polymeric coating extending onto the top of the comb.

BEST MODE FOR CARRYING OUT THE INVENTION

Figure 1:
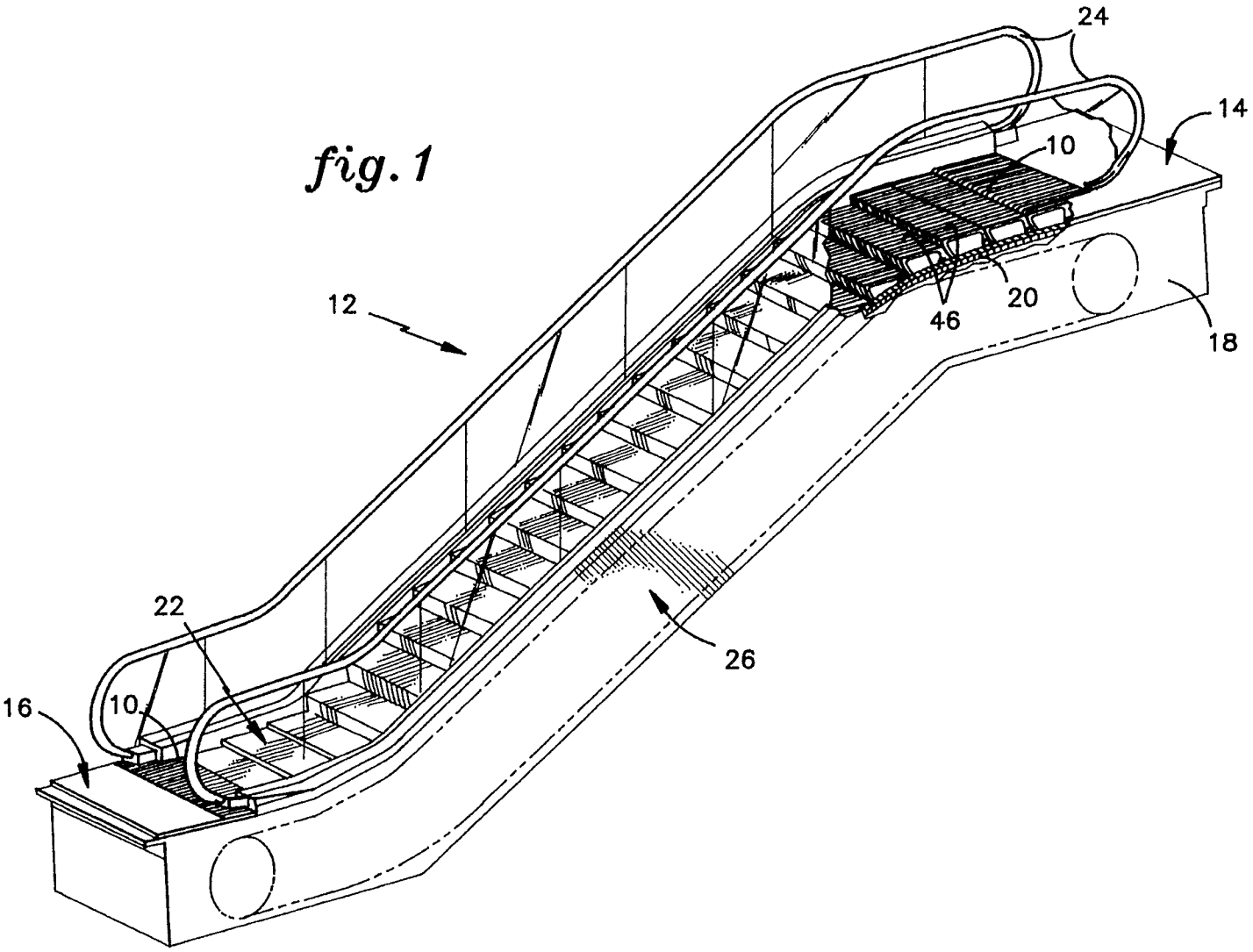
FIG. 1 is a diagrammatic view of an escalator

Referring the FIG. 1, a combplate 10 for a people moving device is shown mounted on escalator 12. The escalator 12 comprises a frame 18, a drive (not shown), a step chain 20, a plurality of tread plates 22, and a pair of balustrade assemblies 24. The frame 18 comprises a first landing 14 and second landing 16 connected to one another by an inclined midsection 26. The drive propels the step chain 20 in a closed loop (shown in phantom—see FIG. 1) from one landing to the other and back. The step chain 20 includes a pair chain strands (not shown) connected to one another by axles (not shown). The tread plates 22, attached to the axles, are driven around the same closed loop as the step chain 20.

Referring to FIGS. 2–4, each landing 14,16 (see FIG. 1) includes a combplate 10 having a body 28, a comb 30 having a plurality of fingers 32, and a wear resistant coating 34. The body 28 includes a plurality of slots 36 extending laterally across the width 38 of the body 28 of the combplate 10. The fingers 32 of the comb 30 extend out lengthwise from the body 28 of the combplate 10, spaced apart and parallel to one another.

The wear resistant coating 34 is a plasticized polyvinyl chloride (PVC-P). A person of ordinary skill in the art will recognize, however, that other polymers, elastomers, or rubber products, may be used alternatively. The PVC-P coating is bonded to the combplate 10 using a dipping process which begins by applying a primer to the section of the combplate 10 to be coated; i.e. applying the primer to only the body 28 will cause the coating 34 to bond to only the body 28. A person of ordinary skill in the art will recognize that the primer may be any one of a number of different phenolic/epoxy based resins with a hydrocarbon solvent Subsequently, the combplate 10 is heated and dipped into a bath of liquid PVC-P (not shown). The thickness 40 of the coating 34 bonded to the combplate 10 increases as a function of time while in the bath. Hence, the thickness 40 of the coating 34 can be manipulated by varying the amount of time a particular section of combplate 10 is exposed to the bath. In the preferred embodiment, for instance, the coating thickness 40 is minimized at the comb 30 end of the combplate 10 to minimize the edge of the coating 34.

The polymeric coating 34 may be manufactured in a wide variety of colors. In a preferred embodiment, the coating 34 assumes a bright yellow color which is customarily used to warn of a safety hazard.

The PVC-P coating 34 may include a plurality of raised surfaces 42. In this embodiment, defined sections of the coating 34 are exposed to bath for extended periods of time. Alternatively, a PVC-P coating 34 having raised surfaces can be bonded to the combplate 10. The raised surfaces 42 increase traction on the PVC-P coating 34 and are therefore desirable in poor traction situations; i.e. water, snow, slush, etc. .

Referring to FIG. 1, in the operation of the escalator 12, the escalator drive propels the step chain 20 and attached tread plates 22 in a closed loop, from one landing 14,16 to the other landing 16,14 and back. As the tread plates 22 pass from the inclined midsection 26 to one of the landings 14,16, the difference in height between the tread plates 22 decreases until the tops 46 of the treadplates 22 in the landing 14,16 are at the same height. In other words, the treadplate tops 46 become co-planar. Subsequently, the co-planar treadplates 22 traveling through the landing 14,16 enter the enclosed portion of the landing 14,16 through the combplate 10. Alternatively, the co-planar treadplates 22 emerge from the enclosed portion of the landing 14,16 underneath the combplate 10 and travel towards the inclined midsection 26. Either way, the treadplates 22 are moving at a constant velocity greater than zero relative to the combplate 10 (which is at zero velocity). The brightly colored coating 34,44 bonded to the combplate 10 draws the passenger's (not shown) attention to the difference in velocities, and consequently allows the passenger to safely enter and exit the escalator 10.

Although this invention has been shown and described with respect to the detailed embodiments thereof, it will be understood by those skilled in the art that various changes in form and detail thereof may be made without departing from the spirit and scope of the claimed invention.

We claim:

1. A combplate for a passenger conveying device, comprising:

a body, having a top surface and a bottom surface;

a comb, having a plurality of fingers with a top surface and a bottom surface; and a wear resistant coating, bonded to said top surface of said body, said coating comprising a thermal setting plasticized polyvinylchloride plastic.

2. A combplate for a passenger conveying device according to claim 1, wherein said wear resistant coating is bonded to said top surface of said fingers.

3. A combplate for a passenger conveying device according to claim 2, wherein said wear resistant coating comprises a plurality of raised surfaces.

4. A passenger conveying device, comprising:

a combplate, said combplate including a body, having a top surface and a bottom surface;

a comb, having a plurality of fingers with a top surface and a bottom surface; and a wear resistant coating, bonded to said top surface of said body, said coating comprising a thermal setting plasticized polyvinylchloride plastic.

5. A passenger conveying device according to claim 4, wherein said wear resistant coating is bonded to said top surface of said fingers.

6. A passenger conveying device according to claim 5, wherein said wear resistant coating comprises a plurality of raised surfaces.

7. An escalator, comprising:

a combplate, said combplate including a body, having a top surface and a bottom surface;

a comb, having a plurality of fingers with a top surface and a bottom surface; and a wear resistant coating, bonded to said top surface of said body, said coating comprising a thermal setting plasticized polyvinylchloride plastic.-

8. An escalator according to claim 7, wherein said wear resistant coating is bonded to said top surface of said fingers.

9. An escalator according to claim 8, wherein said wear resistant coating comprises a plurality of raised surfaces.

* * * * *